US005957618A

United States Patent [19]

Sims et al.

[11] Patent Number: 5,957,618

[45] Date of Patent: Sep. 28, 1999

[54] MANHOLE INSERT

[75] Inventors: James R. Sims, Pittsburgh, Pa.; Jeffrey N. Carr, Toronto, Canada

[73] Assignee: Camtek Construction Products Corporation, Murrysville, Pa.

[21] Appl. No.: 08/995,116

[22] Filed: Dec. 19, 1997

[51] Int. Cl.[6] ..... E02D 29/12

[52] U.S. Cl. ..... 404/25; 52/20

[58] Field of Search ..... 404/25, 26; 52/19, 52/20, 21

[56] References Cited

U.S. PATENT DOCUMENTS

| | | | |
|---|---|---|---|
| 3,621,623 | 11/1971 | Downes . | |
| 4,305,679 | 12/1981 | Modi . | |
| 4,650,365 | 3/1987 | Runnels . | |
| 4,919,564 | 4/1990 | Neathery . | |
| 5,062,735 | 11/1991 | Gaudin . | |
| 5,328,291 | 7/1994 | Wisniewski | 404/25 X |
| 5,382,113 | 1/1995 | Chilton . | |
| 5,401,114 | 3/1995 | Guggemos . | |
| 5,727,351 | 3/1998 | Neathery et al. | 404/26 X |

FOREIGN PATENT DOCUMENTS

WO 91/16505 10/1991 WIPO .

*Primary Examiner*—James A. Lisehora
*Attorney, Agent, or Firm*—Frederick L. Tolhurst

[57] ABSTRACT

A manhole insert wherein gusset (58,60) and (62,64) or offset sections (142,144) and (146,148) anchor pins (94,96) or (158,160) that can be grappled with tools (not shown) to remove the insert. The bottom of the insert includes a conical frustum (40) and an inverted cone (48) or a panel that has a convex inner surface.

10 Claims, 4 Drawing Sheets

MANHOLE INSERT

BACKGROUND OF THE INVENTION

1. Field of the Invention

The subject invention generally relates to improvements in manhole inserts and, more particularly, mechanisms for removing such inserts.

2. Designs of the Prior Art

Various types and styles of manhole inserts are known in the prior art. These devices are intended to prevent surface water from draining to underground vaults, underground passageways and sewer systems. Basically, the inserts have a dish-shaped body and a flange connected to the edge of the body. The flange engages the manway such that the dish-shaped body is suspended in the manway at times when access through the manway is not required. Fluids are captured in the body of the insert. Examples are shown and described in U.S. Pat. Nos. 3,621,623; 4,305,679; 4,650,365; 5,382,113; and 5,401,114.

Manhole inserts known in the prior art have included various mechanisms for removing the insert when it was desired to have access past the manway. Examples of various handles and straps are shown in U.S. Pat. Nos. 4,919,564 and 5,062,735 and International Publication No. WO 91/16505. However, these structures present various disadvantages and difficulties.

For example, when the insert contains water, it is heavy and relatively difficult to lift by means of handles such as those commonly used in the prior art. Moreover, persons who are required to stoop over to grasp and lift a handle on such an insert are exposed to the risk of painful back injuries and other safety risks. Additionally, if the water in the insert is covered by an oil sheen, the internal structure of the insert is visually obscured and it is often difficult to locate the handle. Moreover, it becomes more awkward and difficult to grasp such handles because they are slippery. Finally, the prior art handle mechanisms did not work well or were even incompatible with J-hooks or similar devices that were intended to provide better mechanical advantage for persons attempting to extract the insert.

Accordingly, there was a need in the prior art for an improved mechanism and method by which to remove manhole inserts from manways.

SUMMARY OF THE INVENTION

In accordance with the subject invention, a manhole insert includes pins that are rigidly connected to the insert to provide convenient means for grappling the insert to remove it from the manhole. The insert includes offset sections that are integral with the bottom of the insert. The offset sections receive the ends of the pins which are thus connected to the insert. The offset sections also have one edge that intersects the collar that forms the side of the insert at a location that is closer to the top of the insert than the portions of the bottom that are adjacent to the offset sections. This structure allows the inserts to be efficiently formed in accordance with commercial molding techniques.

Preferably the bottom of the insert is contoured to provide load support strength and to avoid contact between the bottom and the manhole cover. The insert bottom has an inner surface with a generally convex contour and an outer surface with a generally concave contour. Alternatively, the bottom includes a conical frustum in combination with an inverted cone.

Other details, objects and advantages of the present invention will become apparent in the following description of the presently preferred embodiment proceeds.

BRIEF DESCRIPTION OF DRAWINGS

Several presently preferred embodiments of the subject invention as shown in the accompanying drawings in which.

DESCRIPTION OF A PREFERRED EMBODIMENT

Figure 1:
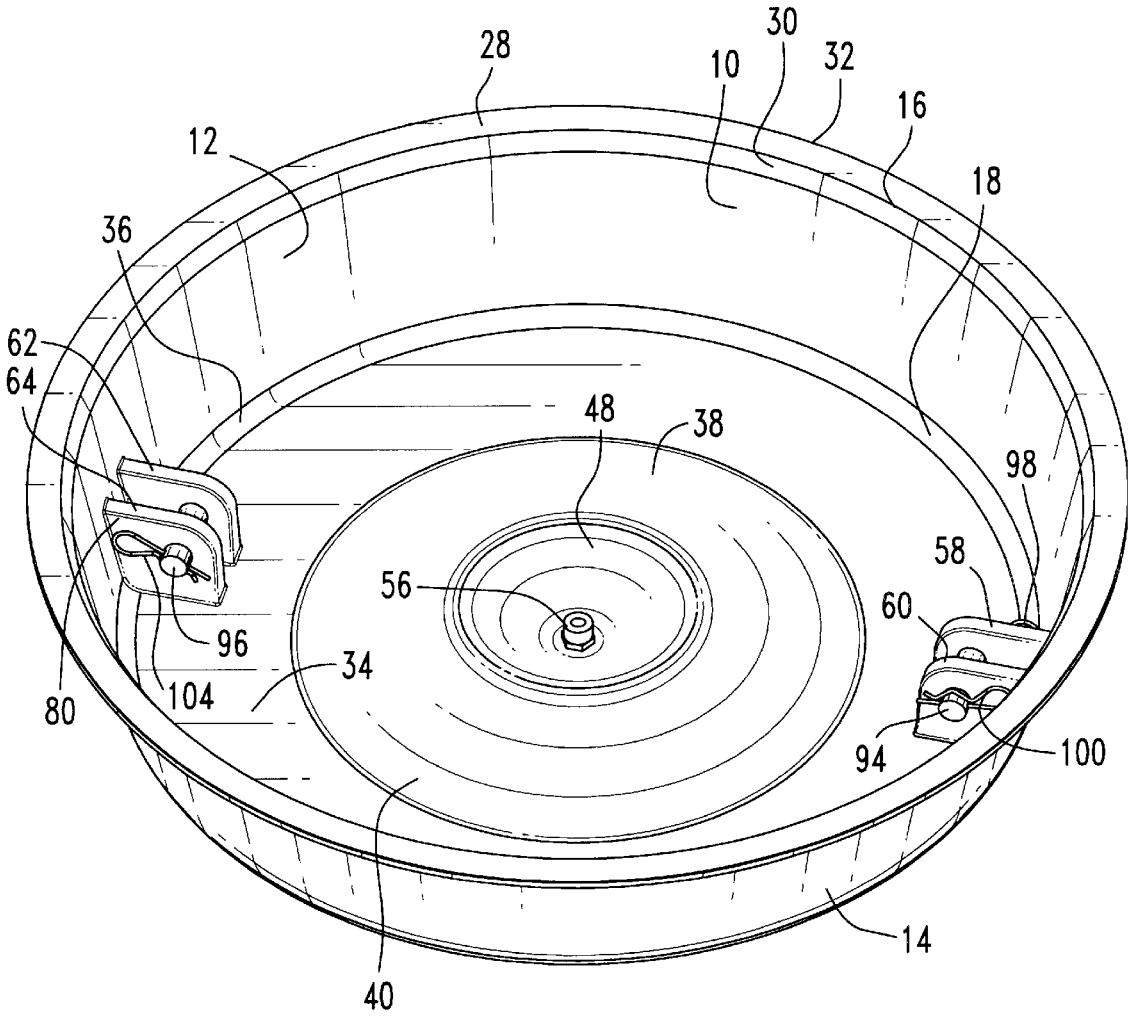
FIG. 1 is a perspective view of the manhole insert herein described with gusset used to retain removal pins.
Figure 3:
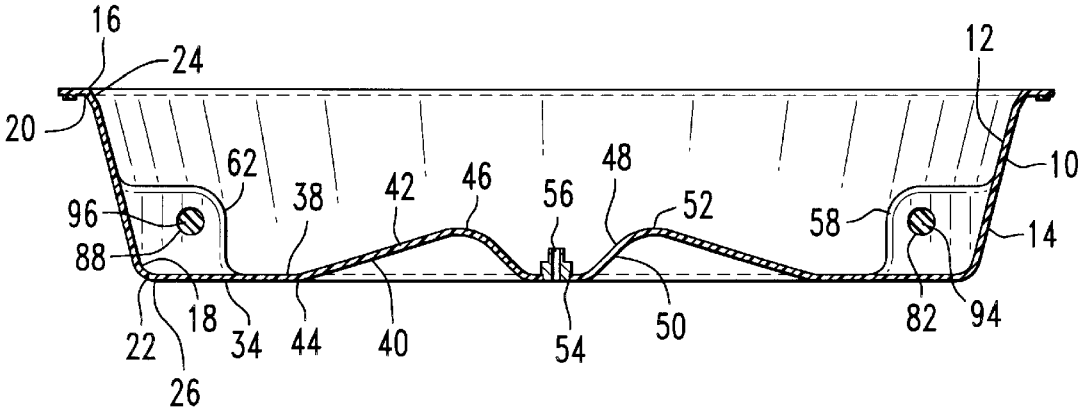
FIG. 3 is cross-sectional elevation of the insert shown in FIGS. 1 and 2 taken along the lines 3—3 of FIG. 2.
Figure 2:
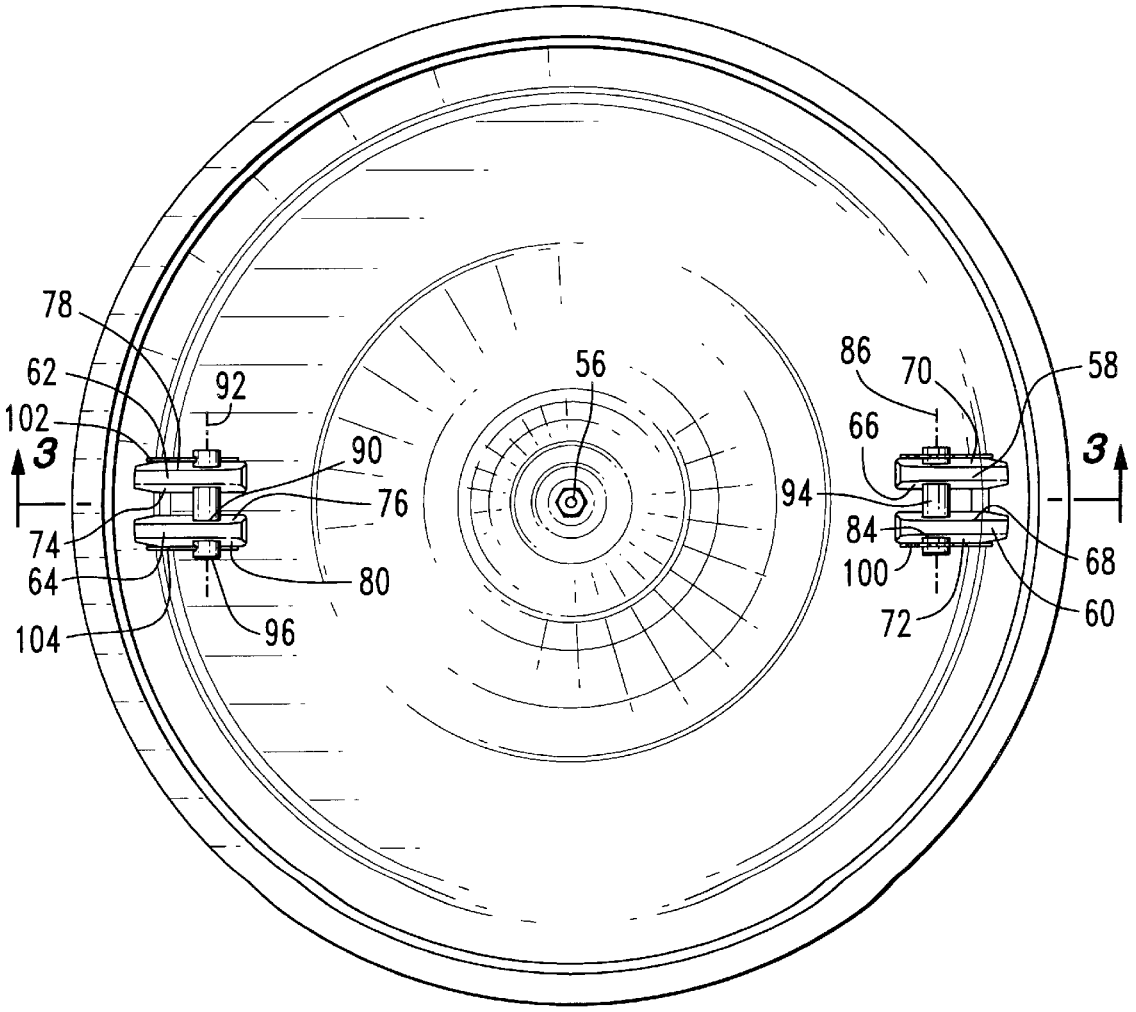
FIG. 2 is a plan view of the insert shown in FIG. 1.

A preferred embodiment of a manhole insert is shown in FIGS. 1–3 wherein a collar or band 10 has a radial inner surface 12 and a radial outer surface 14. Radial inner surface 12 is a continuous surface that is bounded by a first edge 16 and a second edge 18. Similarly, radial outer surface 14 is a continuous surface that is bounded by a first edge 20 and a second edge 22. First edge 16 of inner surface 12 is located oppositely from first edge 20 of outer surface 14 such that a first longitudinal end 24 of band 10 is defined between edges 16 and 20. Second edge 18 of inner surface 12 is located oppositely from second edge 22 of outer surface 14 such that a second longitudinal end 26 of band 10 is defined between edges 18 and 22.

A substantially circular flange or rim 28 is defined between an inside diameter edge 30 and an outside diameter edge 32. Inside diameter edge 30 of rim 28 is connected to first longitudinal end 24 of band 10.

In the preferred embodiment shown in FIGS. 1–3, the bottom of the manhole insert includes a ring-shaped bottom 34 having an outer diameter edge 36 and an inner diameter edge 38. Outer diameter edge 36 is connected to second longitudinal end 26 of collar 10. Inner diameter edge 38 is connected to a conical frustum 40. Conical frustum 40 includes a continuous, cone-shaped outer surface 42 that is located between a base edge 44 and a top edge 46. Frustum 40 is connected at base edge 44 to inner diameter edge 38 of ringshaped bottom 34.

Inverted cone 48 has a continuous outer surface 50 that is located between a base end 52 and an apex 54. Base end 52 is connected to top edge 46 of frustum 40. Inverted cone 48 is oriented in an opposite sense with respect to frustum 40 such that the slope of the continuous outer surface of cone 48 is in an opposite sense with respect to the slope of the continuous outer surface of frustum 40. It has been found that the combination of frustum 40 and cone 48 provides a rigid bottom for the insert. In addition, the structure of frustum 40 and inverted cone 48 affords a structure having a relatively low profile. In this way, there is added clearance from rim 28 and the manhole cover. Thus, when the manhole cover is removed, it is less likely to impact the insert bottom. Moreover, the in the event that the manhole cover contacts the insert bottom, the sloping surface 42 of frustum 40 will allow free movement of the cover across the bottom.

As also shown in FIGS. 1–3, a pressure relief valve 56 is connected to inverted cone 48 at apex 54. Pressure relief value 56 allows gases to pass through in the direction from apex 54 toward base end 52. Thus, relief valve 56 allows any gas pressure under the insert to be relieved before the pressure develops to an unsafe level.

The disclosed insert is further provided with at least two gusset in combination with a pin that is used to remove the insert from the manhole. In the preferred embodiment, two pairs of gusset 58, 60 and 62, 64 are used. Gusset 58, 60 substantially planar shapes that are oriented in parallel relationship with respect to each other and have substantially parallel inboard major surfaces 66, 68 and substantially parallel outboard major surfaces 70, 72 respectively. Similarly, gusset 62, 64 are substantially planar shapes that are oriented in parallel relationship with respect to each other having substantially parallel inboard major surfaces 74, 76 and substantially parallel outboard major surfaces 78, 80 respectively.

Gusset 58, 60 have respective holes 82, 84 that are aligned on a common axis 86. In the preferred embodiment, axis 86 is substantially normal to major surfaces 66, 68, and 70, 72. Similarly, gusset 62, 64 have respective holes 88, 90 that are aligned on a common axis 92 that is substantially normal to major surfaces 74, 76 and 78, 80.

A pin 94 extends through holes 82, 84 and another pin 96 extends through holes 88, 90. Pin 94 is retained in holes 82, 84 by fastening means such as spring clips 98, 100 that are secured to pin 94 adjacent to respective outboard sides 70, 72. Similarly, pin 96 is retained in holes 88, 90 by spring clips 102, 104 that are secured to pin 96 adjacent to respective outboard sides 78, 80. In this way, pins 94 and 96 are retained in gusset 58, 60 and 62, 64 respectively.

Gusset 58, 60 and 62, 64 are secured to radial inner surface 12 of band 10 and to ring-shaped bottom 34. Preferably, gusset 58, 60 are located on radial inner surface 12 such that the angular position of gusset 58, 60 is substantially 180 degrees apart from the angular position of gusset 62, 64.

As will be apparent to those skilled in the art, gusset 58, 60 and pin 94 or gusset 62, 64 and pin 96 provide a convenient structure to attach J-hooks or other equivalent devices for the purpose of removing the insert from the manhole. Thus, gusset 58, 60 and 62, 64 replace handles and straps such as known to the prior art.

An alternative preferred embodiment of the subject invention is shown and described in connection with FIG. 4–6. As shown therein, an annular collar 110 has an inner radial surface 112 with a first edge 114 and a second edge 116. Collar 110 also has an outer radial surface 118 with a first edge 120 and a second edge 122. First edge 114 is oppositely disposed from first edge 120 and first edges 114, 120 cooperate to define a first longitudinal end 124 of collar 110. Second edge 116 is oppositely disposed from second edge 122 and second edges 116, 122 cooperate to define a second longitudinal end 126 of collar 110.

A ring 128 includes an inner diameter edge 130 and an outer diameter edge 132. Inner diameter edge 130 of ring 128 is connected to first longitudinal end 124 of collar 110.

Figure 4:
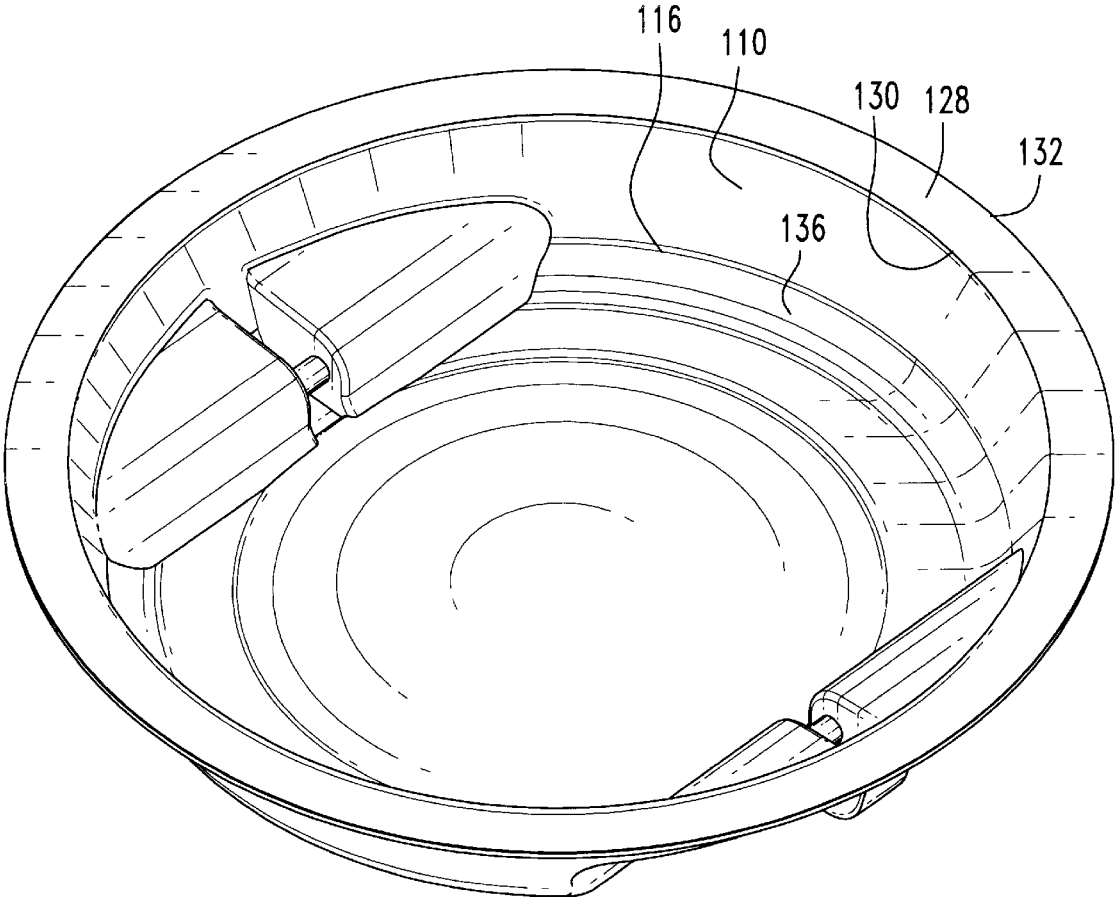
FIG. 4 is a perspective view of the manhole insert herein described with raised sections used to retain removal pins.
Figure 6:
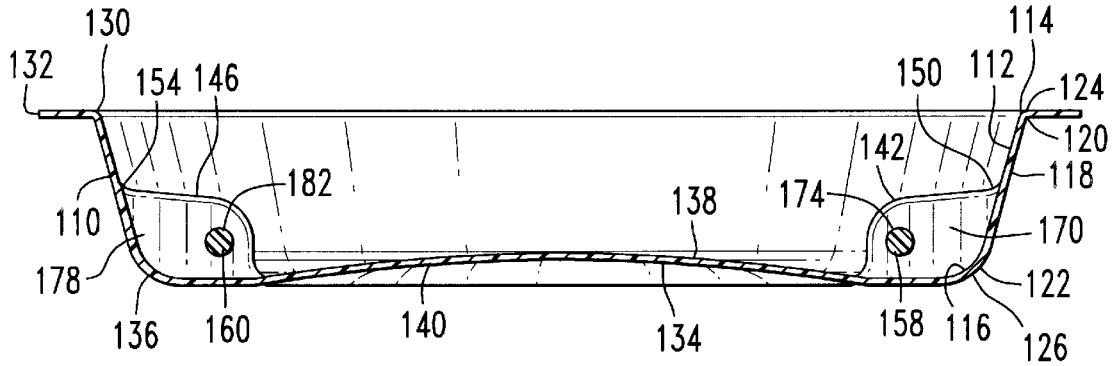
FIG. 6 is a cross-sectional elevation of this insert shown in FIGS. 4 and 5 taken along the lines 6—6 of FIG. 5.
Figure 5:
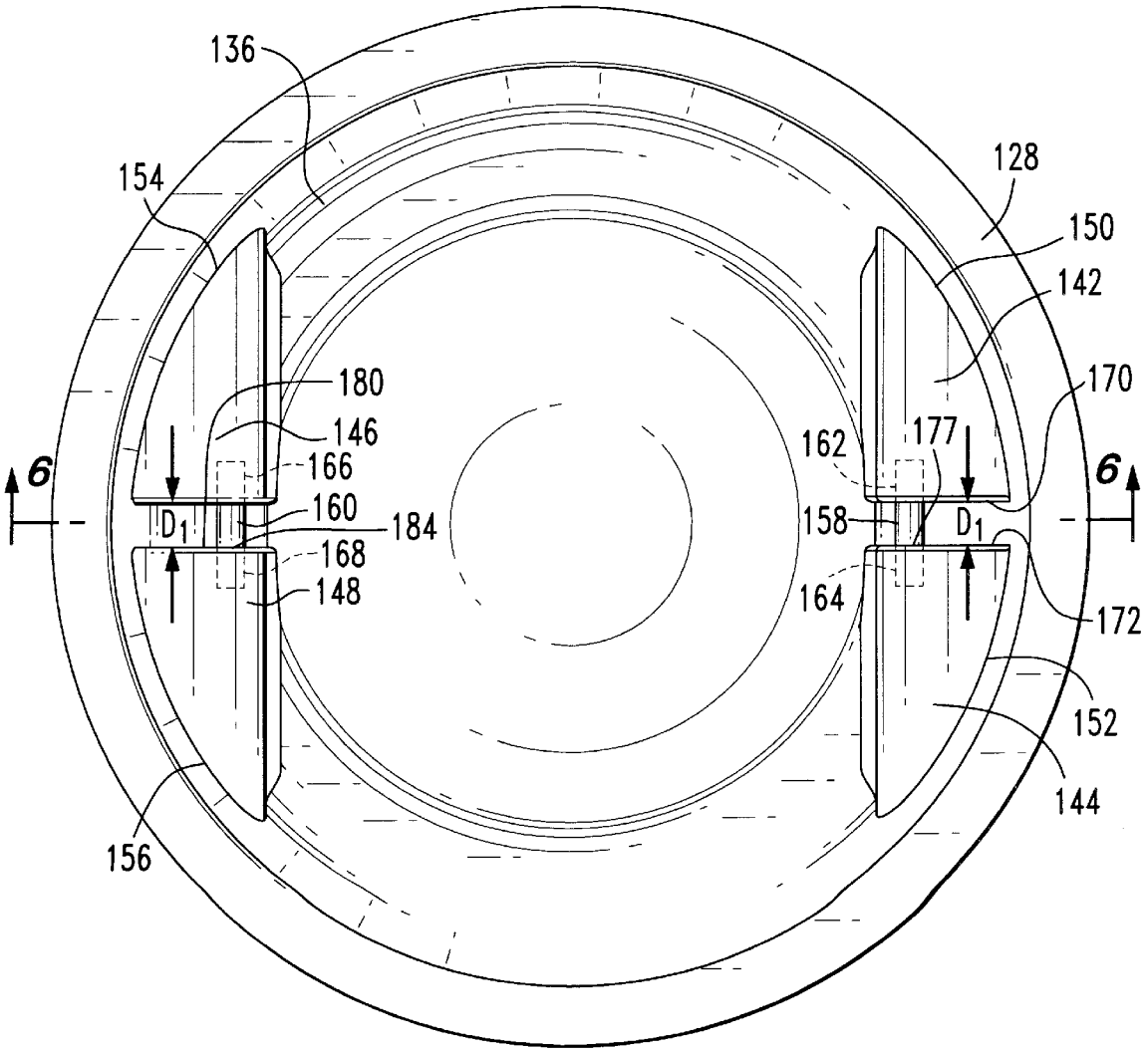
FIG. 5 is a plan view of the insert shown in FIG. 4.

As further shown in FIG. 4–6, a bottom panel 134 has a perimeter edge 136 that is connected to second longitudinal end 126 of collar 110. Bottom panel 134 closes the second longitudinal end 126 of collar 110 and has an inside surface 138 that is generally convex and an outside surface 140 that is generally concave. By this structure, bottom panel 134 can better support loadings at times when the insert contains water. In addition, this structure allows for flexure and expansion of the bottom panel 134 in response to freezing of water that has collected in the insert.

Bottom panel 134 further includes two pairs of offset sections 142, 144 and 146, 148. Offset sections 142 and 146 are first offset sections of the respective pairs and offset sections 144 and 148 are second offset sections of the respective pairs. First offset sections 142 and 146 include edges 150 and 154 respectively that are also sections of perimeter edge 136. Second offset sections 144 and 148 include edges 152 and 156 respectively that are also sections of perimeter edge 136. Edges 150, 152, 154 and 156 are offset in that they are joined with collar 110 at a location that is closer to first longitudinal end 124 of collar 110 then other portions of perimeter edge 136.

The insert in FIGS. 4–6 further includes a rigid member such as pins 158, 160 with pin 158 having ends 162, 164 and with pin 160 having ends 166, 168. The length of pins 158, 160 is selected in correspondence with the lateral dimension $D_1$ between first sections 142, 146 and second sections 144, 148, such that end 162 of pin 158 is received in a recess of first section 142 and the opposite end 164 of pin 158 is received in a recess of second section 144. Similarly, one end 166 of pin 160 is received in a recess of first section 146 and the opposite end 168 of pin 160 is received in a recess of second section 148. In this way, pin 158 is secured to offset sections 142 and 144 and pin 160 is secured to offset sections 146 and 148. Pins 158 and 160 are thereby presented for engagement by a J-hook or similar tool as will be familiar of those skilled in the art.

In the example of this preferred embodiment of FIG. 4–6, the top surfaces of sections 142 and 144 generally cooperate to define a sector of the inner radial surface 112 of collar 110. Similarly, the top surfaces of sections 146 and 148 also generally cooperate to define a sector of the inner radial surface 112 of collar 110.

Also in the example of the preferred embodiment of FIG. 4–6, offset sections 142 and 144 include walls 170 and 172 respectively. Walls 170 and 172 are generally oriented parallel with respect to each other and contain recesses 174 and 177 respectively. Similarly, offset sections 146 and 148 include walls 178 and 180 respectively. Walls 178 and 180 are generally oriented parallel with respect to each other and contain recesses 182 and 184 respectively. This structure allows for easy access with J-hooks and similar tools.

In the operation of the subject invention, the insert is placed in the manway to capture water and other foreign matter. When there is a need to enter the vault or other area, the manhole cover is removed. The pins of the insert are then grappled with J-hooks or equivalent devices and the insert is removed.

While presently preferred embodiment of the invention disclosed herein have been shown and described, the invention is not limited thereby, but may be otherwise variously embodied within the scope of the following claims.

We claim:

1. A manhole insert comprising a band having a radial inner surface with first and second edges and having a radial outer surface with first and second edges, the first edge of said radial inner surface being opposed to the first edge of said radial outer surface to define a first longitudinal end therebetween and the second edge of said radial inner surface being opposed to the second edge of said radial outer surface to define a second longitudinal end therebetween;

a substantially circular rim that is connected to the first longitudinal end of the band;

a ring-shaped bottom having an outer diameter edge and an inner diameter edge, the outer diameter edge of the ring-shaped bottom being connected to the second longitudinal end of said band;

a conical frustum having a continuous, cone-shaped outer surface between a base edge and a top edge, the base edge of the frustum being connected to the inner diameter edge of the ring-shaped bottom; and an inverted cone having a continuous, cone shaped outer surface between a base end and an apical end, the base end of said cone being connected to the top edge of the conical frustum, said inverted cone being oriented in opposite sense with respect to the conical frustum such that the slope of the continuous outer surface of the cone is in an opposite sense to the slope of the continuous outer surface of the conical frustum.

2. The manhole insert of claim 1 further comprising;

two gusset, each of said gusset having a generally planar shape and oriented substantially parallel with respect to each other such that each of said gusset has a respective outboard planar surface and an inboard planar surface, each of said gusset being secured to the inner radial surface of the band and to the ring-shaped bottom; each of said gusset having a hole therein that is centered on a common axis;

a pin that is received in each of the holes of said gusset, and means for retaining the pin in both of the holes of said gusset.

3. The manhole insert of claim 2 wherein each of said gusset has a hole that is centered on a common axis that is substantially orthogonal to each of said two gusset.

4. The manhole insert of claim 2 wherein said retaining means comprises first and second spring clips, each of said first and second spring clips being secured to the pin on respective outboard sides of the two gusset.

5. The manhole insert of claim 2 further comprising:

a pressure relief valve that is secured to the manhole insert at the apical end of the inverted cone.

6. A manhole insert comprising:

an annular collar having an inner radial surface and an outer radial surface, said collar also having a first longitudinal end and a second longitudinal end a lip having an inner diameter edge that is connected to the first longitudinal end of the annular collar;

a bottom panel that is generally planar member having an inside surface and an outside surface that is oppositely located from said inside surface, said bottom panel also having an outer perimeter edge that is connected to the second longitudinal end of the collar, said bottom panel further having first and second raised sections, said first and second raised sections having at least one sidewall, with the sidewall of said first section being opposed to the sidewall of said second section; and a bar having one end that is received in a recess of the sidewall of said first section, said bar also having another end that is received in a recess of the sidewall of said second section.

7. The manhole insert of claim 6 wherein the inside surface of the bottom panel is generally convex and wherein the outside surface of the bottom panel is generally concave.

8. The manhole insert of claim 6 wherein the first and second sections respectively include a portion of said bottom panel that is offset closer to the first longitudinal end of said collar than portions of said bottom panel that are adjacent to said first and second sections.

9. A manhole insert comprising:

a collar, that is defined between an inner annular surface with first and second edges and an outer annular surface with first and second edges, the respective first edges of said inner and outer annular surfaces being oppositely disposed and cooperating to define a first longitudinal end of said collar therebetween, and the respective second edges of said inner and outer annular surfaces being oppositely disposed and cooperating to define a second longitudinal end of said collar therebetween;

a ring that is defined between an inner diameter edge and an outer diameter edge, with the inner diameter edge of said ring being connected to the first longitudinal end of said collar;

a bottom panel having a perimeter edge that is connected to the second longitudinal end of said collar, said bottom panel closing the second longitudinal end of said collar, said bottom panel also having at least first and second offset sections, a section of the perimeter edge of said bottom panel forming one edge of each of said first and second offset sections and wherein said section of the perimeter edge of said bottom panel is connected to said collar at a location closer to the first longitudinal end than other portions of the perimeter edge of said bottom panel;

a rigid member having first and second ends with a first end being received in a recess of the first offset section and with a second end being received in a recess of the second offset section.

10. The manhole insert of claim 9 wherein said first and second offset sections further include at least one wall that is oriented generally orthogonally to said bottom panel and wherein the recess of the offset sections is located in said wall.

* * * * *